US007063551B1

(12) United States Patent
Lin

(10) Patent No.: US 7,063,551 B1
(45) Date of Patent: Jun. 20, 2006

(54) CONNECTING DEVICE FOR AN ANTENNA

(75) Inventor: Kuotung Lin, Kaohsiung (TW)

(73) Assignee: Huang Liang Precision Enterprise Co., Ltd., Kaohsiung (TW)

( * ) Notice: Subject to any disclaimer, the term of this patent is extended or adjusted under 35 U.S.C. 154(b) by 0 days.

(21) Appl. No.: 11/269,528

(22) Filed: Nov. 9, 2005

(51) Int. Cl.
*H01R 13/62* (2006.01)
*H01R 4/38* (2006.01)

(52) U.S. Cl. ..... 439/322

(58) Field of Classification Search ..... 439/322, 439/321, 320, 323, 578
See application file for complete search history.

(56) References Cited

U.S. PATENT DOCUMENTS 2,173,643 A * 9/1939 Moser ..... 174/75 C

* cited by examiner

*Primary Examiner*—Javaid H. Nasri
(74) *Attorney, Agent, or Firm*—Rosenberg, Klein & Lee

(57) ABSTRACT

A connecting device for an antenna includes a taper section provided on a main body of a male connector and a recess formed between the taper section and a turning part. A wedge-shaped elastic element is disposed in the recess for forcing the elastic element towards the taper section to secure the male and female connectors together. First ends and second ends of the male and female connectors are in a full contact, providing a high frequency signal transmission.

1 Claim, 5 Drawing Sheets

CONNECTING DEVICE FOR AN ANTENNA

BACKGROUND OF THE INVENTION

1. Field of the Invention

This invention relates to a connecting device for an antenna, and more particularly to a recess formed between a taper section of a main body and a turning part for receiving an elastic element, urging the elastic element to maintain a good contact of first ends and second ends of a male connector and a female connector.

2. Description of Prior Art

An antenna structure currently used on the market, as shown in FIG. 4, comprises a male connector A and a female connector B. The male connector A has a main body A1 with a turning part A2 sleeved thereon. The main body A1 is connected with an antenna C. When rotating the antenna C, the main body A1 also rotates simultaneously. A spring A3, a washer A4 and an elastic element A5 are provided between the main body A1 and the turning part A2. When the male connector A and the female connector B are screwed together, the spring A3 will force the washer A4, which in turn presses the elastic element A5. The contact between the elastic element A5 and the main body A1 produces friction to prevent the main body A1 and the turning part A2 from movement. The rotation of the antenna C is free from linking with the turning part A2 to rotate.

However, due to the screwed connection between the male connector A and the female connector B, a differential will be produced. When a first end A6 in a turning part A2 of the male connector A is in contact with a first end B2 in a case B1 of the female connector B, a second end A7 of the main body A1 of the male connector A and a second end B3 in the female connector B will not be in a full contact, causing a gap formed thereat. This causes a bad or improper transmission of signal. Alternatively, as shown in FIG. 5, when the male connector A and the female connector B are screwed together, the second end A7 of the main body A1 of the male connector A is in a full contact with the second end B3 of the female connector B, a gap is formed between the first end A6 in the turning part A2 of the male connector A and the first end B2 in the case B1 of the female connector B, which easily loosens the male connector A and the female connector B. This causes a bad or improper transmission of signal.

SUMMARY OF THE INVENTION

According to the invention there is provided a connecting device for an antenna comprising a taper section provided on a main body and a recess formed between the taper section and a turning part. A wedge-shaped elastic element is disposed in the recess for forcing the elastic element towards the taper section.

It is the primary object of the present invention to provide a connecting device for an antenna, which uses an elastic element to provide an urging force to ensure a full contact between a male connector and a female connector so as to provide a good transmission of signal.

It is another object of the present invention to provide a connecting device for an antenna, which has the elastic element to provide a transverse urging force towards a turning part to prevent it from rotating with respect to a main body when rotating an antenna.

DETAILED DESCRIPTION OF THE PREFERRED EMBODIMENT

Figure 1:
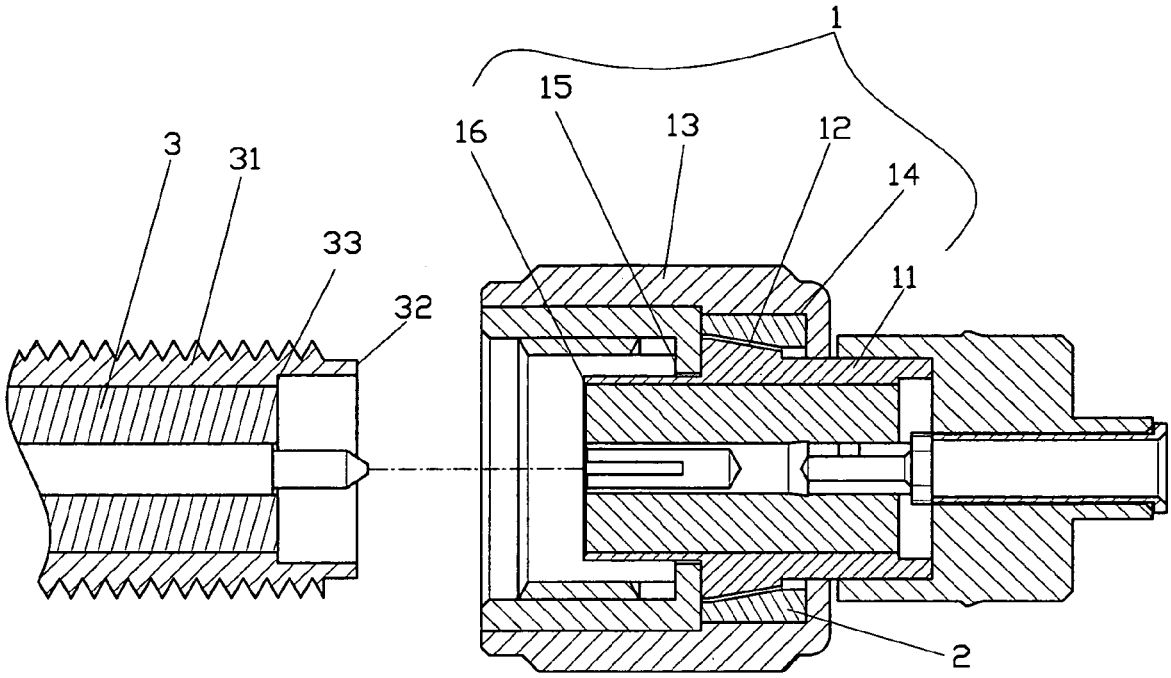
FIG. 1 is an exploded view of the present invention.

The present invention comprises a male connector 1, an elastic element 2 and a female connector 3.

The male connector 1 has a main body 11. The main body 11 has a taper section 12 on the outer edge thereof. A turning part 13 is sleeved on the main body 11 with a recess 14 formed between the turning part 13 and the taper section 12 of the main body 11. The turning part 13 has a first end 15 therein, while the main body 11 has a second end 16 thereon.

The elastic element 2 is disposed in the recess 14 of the male connector 1. The elastic element 2 is shaped like a wedge and made of silica gel.

The female connector 3 is screwed to the male connector 1 and comprises a case 31. The case 31 has a first end 32 thereon, while the female connector 3 has a second end 33 therein.

Figure 2:
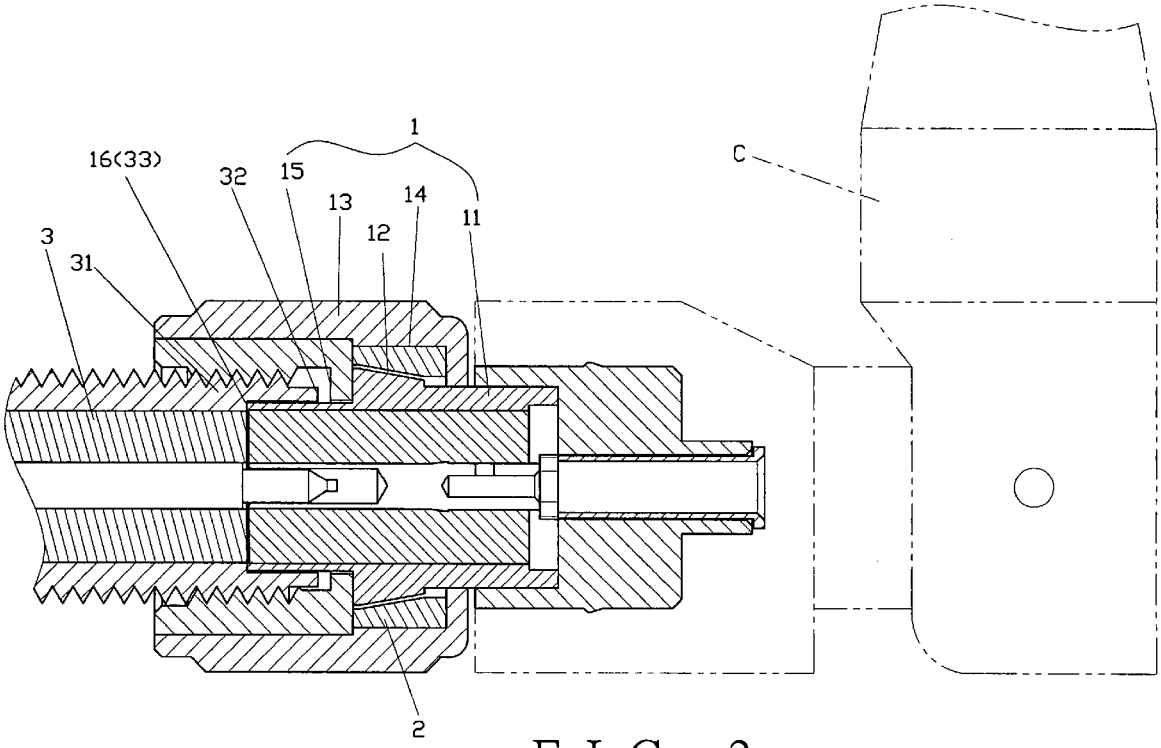
FIG. 2 is a cross-sectional view of the present invention in an assembled status.
Figure 3:
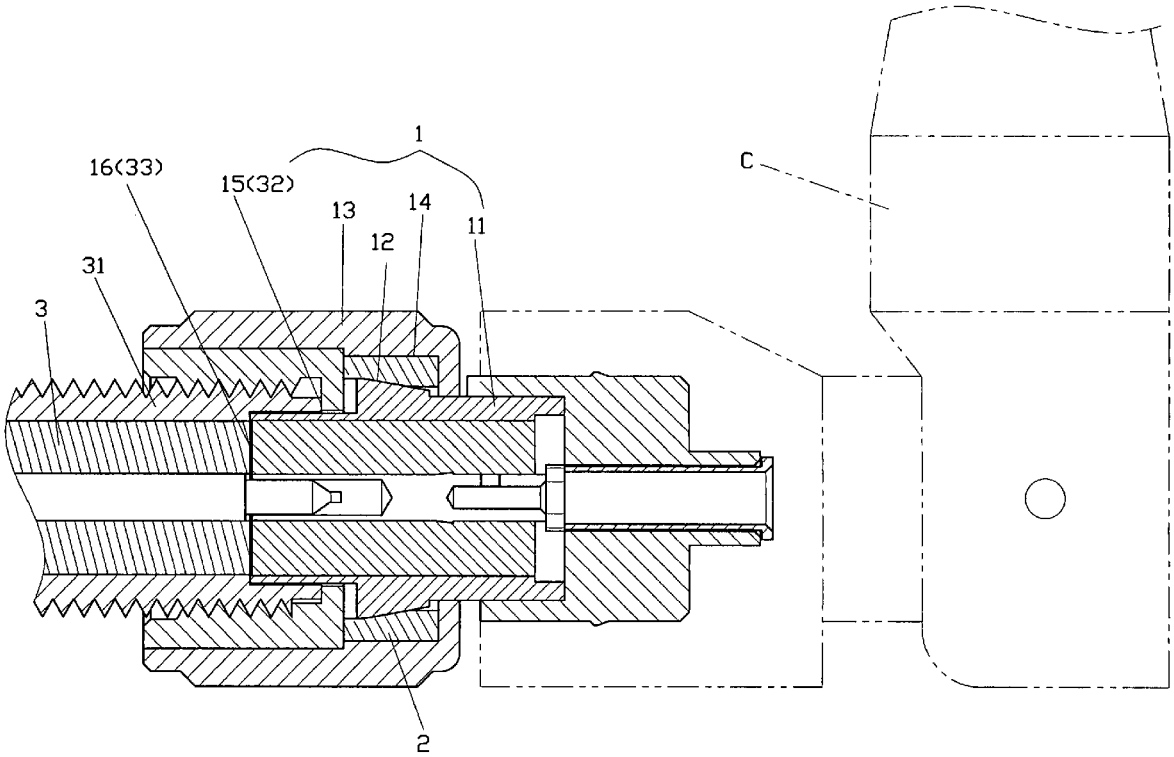
FIG. 3 is a side cross-sectional view of the present invention showing that an elastic element is forced.
Figure 4:
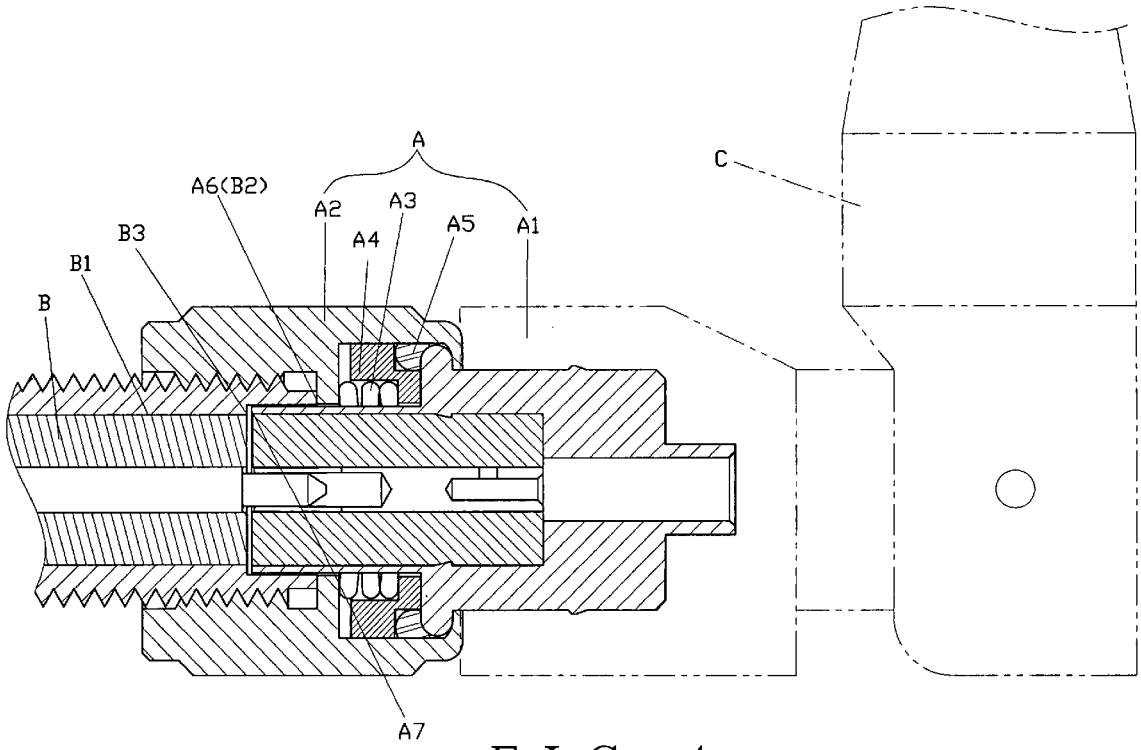
F I G . 4 (PRIOR ART)
FIG. 4 is a cross-sectional view of a prior art showing a gap formed between second ends of an antenna connector.
Figure 5:
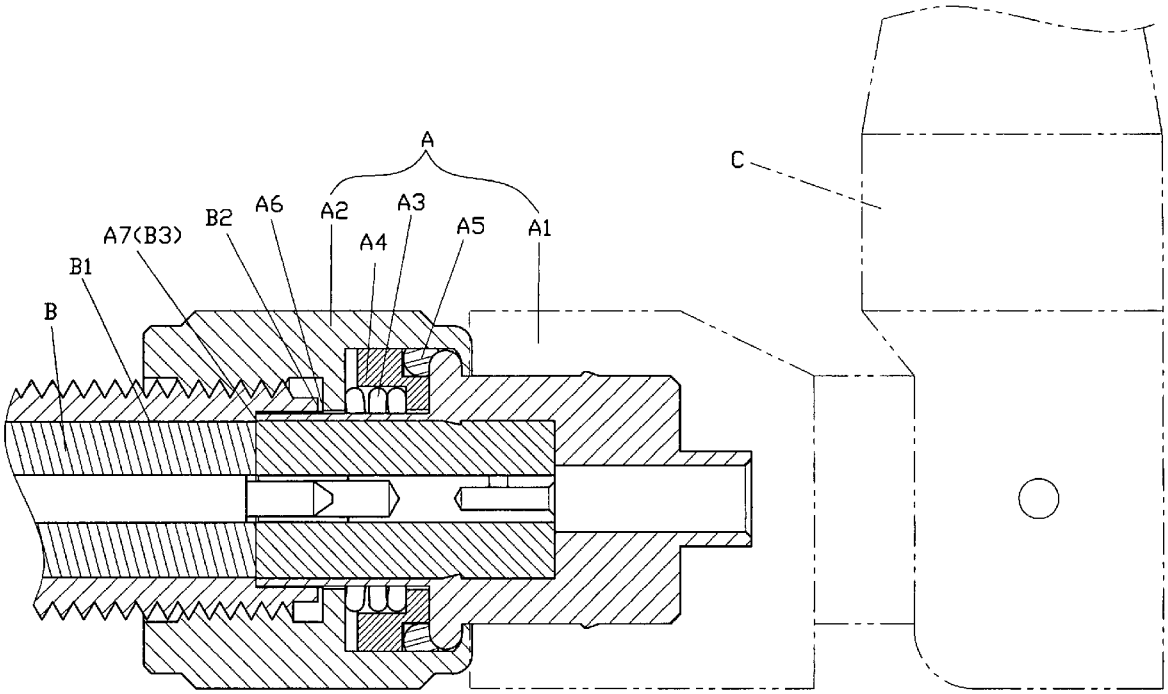
F I G . 5 (PRIOR ART)
FIG. 5 is a cross-sectional view of the prior art showing a gap formed between first ends of an antenna connector.

To assemble the present invention, as shown in FIG. 2, the main body 11 of the male connector 1 is connected to an antenna C. When rotating the antenna C, the main body 11 will also rotate simultaneously. When connecting the male connector 1 and the female connector 3, the second ends 16 and 33 will be in contact first, and the first end 15 of the turning part 13 of the male connector 1 and the first end 32 of the case 31 of the female connector 3 will form a gap thereat. By continuously rotating the turning part 13 of the male connector 1, the elastic element 2 will be urged to be in contact with the taper section 12 of the main body 11. The elastic element 2 at this moment will be deformed, as shown in FIG. 3. The elastic element 2 provides an axial pushing force to urge the first end 15 in the turning part 13 of the male connector 1 to engage with the first end 32 of the case 31 of the female connector 3, providing a stable and good transmission of signal. The axial pushing force from the elastic element 2 further urges the turning part 13, avoiding rotation of the main body 11 with respect to the turning part 13. Arbitrarily rotating the antenna C will still gain a best transmission of signal.

What is claimed is:

1. An electrical connecting device for an antenna comprising:

a male electrical connector having a main body with a turning part sleeved thereon, said turning part comprising a first end therein, said main body comprising a second end thereon;

a female electrical connector screwed to said male electrical connector, said female connector comprising a case, said case comprising a first end thereon, said female electrical connector comprising a second end therein, and characterized in that:

said main body comprising a taper section at an outer edge, a recess being formed between said taper section and said turning part, a wedge-shaped elastic element being disposed in said recess for urging said taper section of said main body of said male electrical connector.

* * * * *